United States Patent [19]

Züfle

[11] Patent Number: 4,535,478

[45] Date of Patent: Aug. 20, 1985

[54] BODY ARMOR

[76] Inventor: Tim T. Züfle, 230 Lafayette St., Gretna, La. 70053

[21] Appl. No.: 496,618

[22] Filed: May 20, 1983

[51] Int. Cl.[3] ..... F41H 1/02

[52] U.S. Cl. ..... 2/2.5

[58] Field of Search ..... 2/2.5

[56] References Cited

U.S. PATENT DOCUMENTS

| | | | |
|---|---|---|---|
| 2,517,615 | 8/1950 | Webster et al. | 2/2.5 |
| 2,879,654 | 3/1959 | Evans | 2/2.5 X |
| 3,567,568 | 3/1971 | Windecker | 2/2.5 |
| 3,634,889 | 1/1972 | Rolsten | 2/2.5 |
| 3,783,449 | 1/1974 | Davis | 2/2.5 |
| 3,855,632 | 12/1974 | Davis | 2/2.5 |
| 4,266,297 | 5/1981 | Atkins | 2/2.5 |
| 4,413,357 | 11/1983 | Sacks | 2/2.5 |

*Primary Examiner*—Louis K. Rimrodt

*Attorney, Agent, or Firm*—Harvey B. Jacobson

[57] ABSTRACT

An article of body armor comprises an undershirt-type carrier garment with front and rear pockets receiving armor panel inserts of layered bullet-resistant sheet material. The inserts and receiving pockets are standardized in dimensions so that the inserts may be interchanged as between pockets and used in different carrier garments.

9 Claims, 6 Drawing Figures

BODY ARMOR

BACKGROUND OF THE INVENTION

This invention relates to body armor worn for personal protection against smallarms fire and the like.

Most conventional body armor of the type often referred to as a "bullet-proof vest" for protecting a wearer's torso, is incorporated in a garment designed primarily as an armor carrier and secondarily as a garment. Such garments tend to be bulky, unsightly, and uncomfortable to wear. It is an object of the present invention to provide a novel form of body armor which may be more acceptable in use and which may exhibit additional advantages compared with known-types.

SUMMARY OF THE INVENTION

The invention is based on a modular concept of design, whereby an article of body armor comprises a carrier garment, preferably in the form of a standard-style undergarment, such as a T-shirt and the like, and at least one armor panel insert which may be of soft armor construction made of layers or plastic sheet, the panel being adapted for removable insertion into purpose-made receiving means, such as a pocket, formed in the carrier garment.

The carrier garment may, for example, include internal front and rear pockets of conforming standardized shape and dimensions, for covering substantial areas of a wearer's chest and back respectfully, each pocket being adapted to receive a standardized armor insert panel. Further, the carrier garment may include juxtaposed pockets for receiving a plurality of the armor panels in layered relation, if additional armor protection is desired at a required location.

The inventive combination, involving removable armor panels of standardized shape and size provides advantageous flexibility of armor makeup. Thus, as noted above, the armor lends itself to selective adjustment of the degree of protection afforded, by selecting the number of armor panel layers used. Additionally, the standardized panels may be transferred from one carrier garment to another (the receiving pockets also being standardized) so that, for example, if the armor is to be worn on a day-to-day basis, one carrier garment may be washed or laundered while another is in use. Also, by standardizing the panels and pockets, the same panels may be used for different sized garments in a range or line of garments. Standardization additionally simplifies and produces economies in manufacture.

As noted, the carrier garment may be a standard-style undergarment such as a T-shirt. Thus, the armor panels may be carried snugly directly against a wearer's body. Since the carrier may be of standard undershirt form, greater wearer comfort may result than with conventional armor.

In accordance with another feature of the invention, the pockets may be a specialized construction providing an armor panel retention feature.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

The illustrated article of body armor comprises a carrier garment 10 in the form of a standard-style undergarment and separable armor panel inserts 12, 14 and 16 which may be disposed in purpose-made internal pockets in the undergarment as will be described.

As illustrated, carrier garment 10 is in the form of a T-shirt which may be of any suitable material such as cotton or a cotton-polyester blend. Other style undergarments may also be suitable for use as carrier garments.

Figure 1:
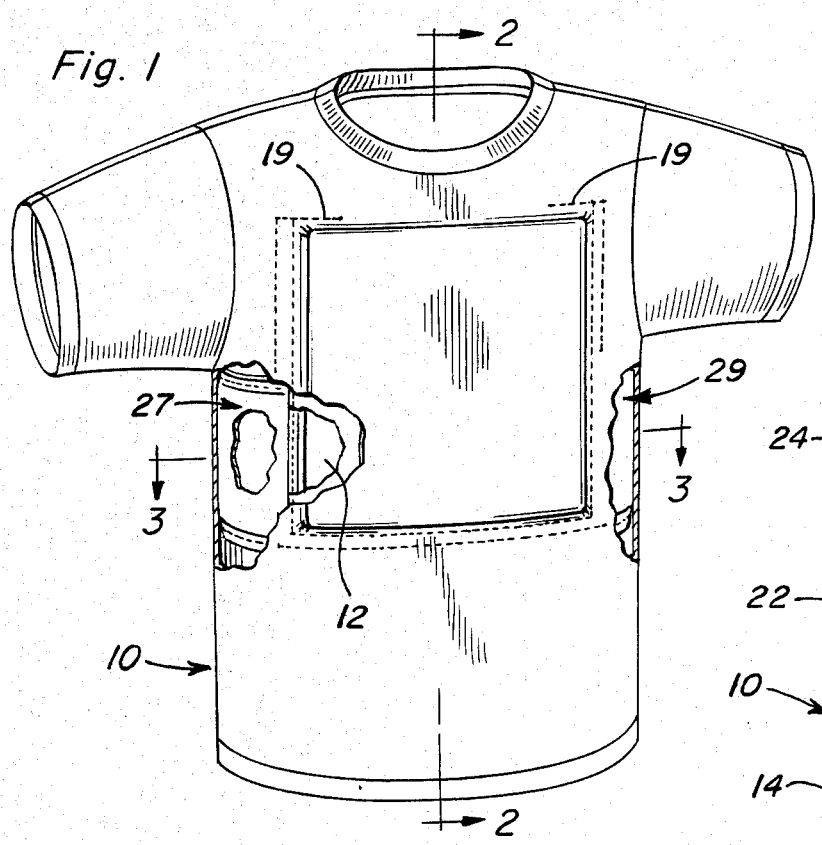
FIG. 1 is a perspective view, with portions broken away, of an article of body armor in accordance with the invention, comprising a carrier garment and armor insert panels.
Figure 4:
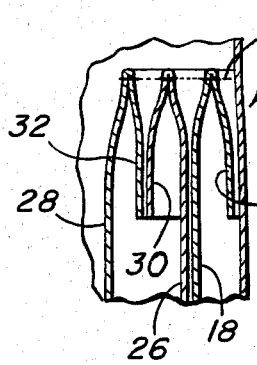
FIG. 4 is a sectional view, on an enlarged scale, of part of a pocket construction used in the carrier garment.

Internally, garment 10 has a front pocket formed by a sheet of material 18 seamed along its sides and bottom to the front of the garment and also seamed along the top at the corner portions 19 thereof (see FIG. 1), so as to define a central pocket opening between the seamed corner portions. Further, the upper edge portion of sheet 18 is folded over and seamed at 20 along the fold to form a flap 21 (best seen in FIG. 4). Garment 10 also has a rear internal pocket formed by a sheet of material 22 seamed to the rear of the garment in the same manner as sheet 18 and also formed with a flap 24 at the open edge. The front and rear pockets are of standardized size and shape, each being adapted to received a standardized armor panel insert 12 and 14 to cover substantial areas of a wearer's chest and back. For example, the inserts may each measure about $12 \times 12\frac{1}{2}$ inches. The armor inserts may be of a soft, flexible, armor construction comprising, for example, bullet-resistant material such as multiple layers of "Kevlar", an aramid fiber manufactured by E. I. du Pont de Nemours Co., Inc., in suitable sheathing. A preferred construction comprises, for example, nine layers of "Zepel-D" treated $31 \times 31$ count, 1000 denier, "Kevlar 29" fiber. Preferably the layers may be cut "on the square" rather than bias cut in order to enhance strength.

Figure 2:
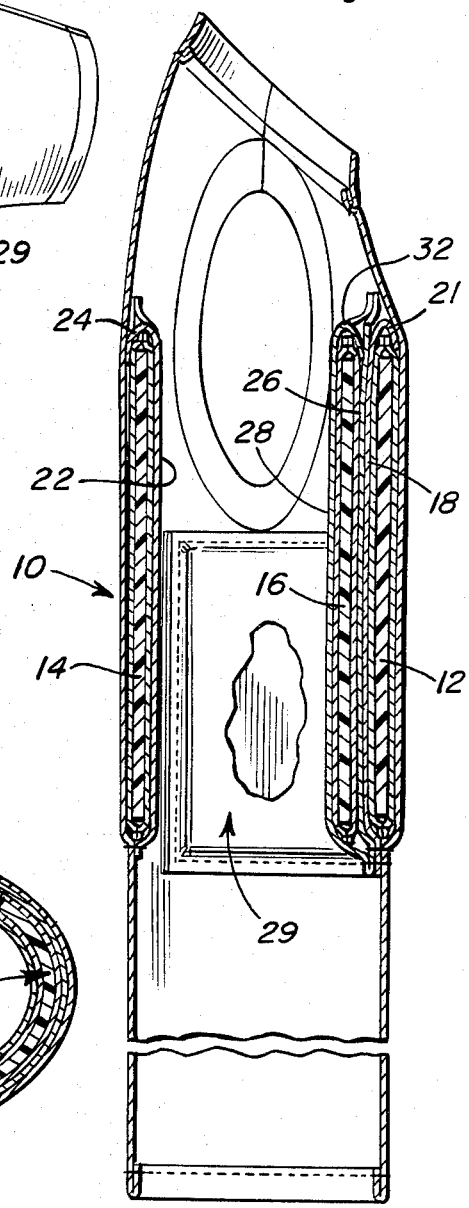
FIG. 2 is a sectional view on line 2—2 of FIG. 2.
Figure 3:
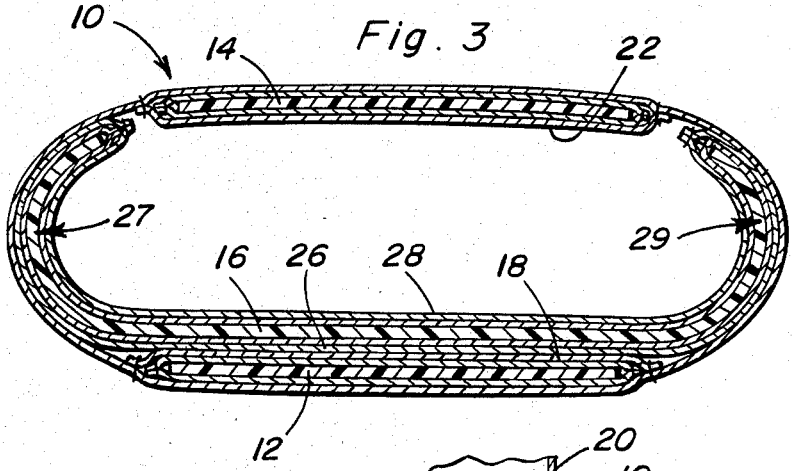
FIG. 3 is a sectional view on line 3—3 of FIG. 1.
Figure 6:
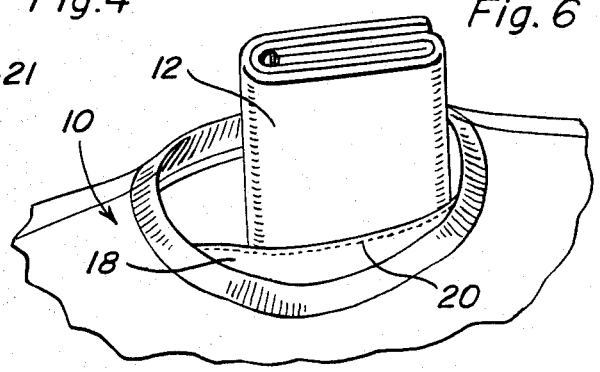
FIG. 6 is a perspective view of a neck portion of the carrier garment illustrating the manner of insertion of an armor insert panel into a pocket.

To insert a panel in a pocket, it may be folded as shown in FIG. 6, manipulated through the neck opening of the garment and into the respective pocket through the upper opening thereof. When in the pocket, the insert may be unfolded and flattened into place. Then, pulling flap 21 (or 24) over the edge of the panel, as shown in FIG. 2, serves as a means for retaining the panel in the pocket along with the corner seams 19. It is possible with the flap construction for the pocket openings to be at the sides or bottoms of the pockets rather than at the top as illustrated.

A panel may be removed from its pocket simply by pulling back the respective flap and withdrawing the panel from the pocket.

Figure 5:
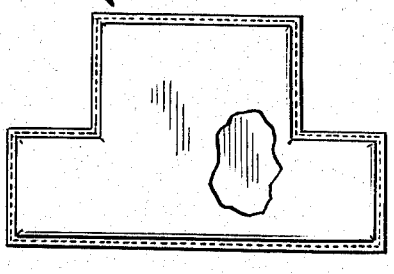
FIG. 5 is an elevational view, part broken away, of an armor insert panel.

The construction thus far described utilizes standardized armor insert panels in standardized pockets, so that the panels may be interchangeably inserted in different pockets and different garments, even garments of different sizes. As illustrated, however, garment 10 also includes additional front pockets formed by material sheets 26 and 28, suitably seamed to the interior of the carrier garment behind sheet 18. The additional sheets which are also provided with panel-retaining flaps 30, 32 may be of like size to sheet 18 in order to form additional standardized pockets. In the illustrated form, however, sheets 26 and 28 have lateral extensions thereby forming pockets of inverted T shape (generally indicated by references 27 and 29) adapted to receive armor insert 16 (FIG. 5) of equivalent T-shape for protecting a wearer's kidney regions. Insert 16 may be positioned in place in like manner to inserts 12 and 14 and insert 16, as well as its receiving pocket(s) may also be of a second standardized form to allow for interchangeability between carrier garments. The arrangement provides selectivity as regards the layers of protection used at the front of the garment. While the illustrated construction has a pair of additional front pockets, only one additional armor insert 16 has been illustrated.

With the armor inserts in place, a wearer may put garment 10 on, wear and remove it like a regular undershirt without the discomfort and unsightliness of other types of body armor so that it can be worn all the time. With inserts 12 and 14 in place, the entire assembly may, for example, weigh only about 1½ pounds. The modular style armor inserts and insert receiving pockets afford flexibility of usage as previously described and provide economies in manufacture when producing a line of garments. The garment carrier may be laundered by conventional techniques and the inserts may be wiped clean with a damp cloth or, if necessary, the insert may be hand washed in cool water with a mild soap and thoroughly rinsed and hung to air dry. It is also possible to machine wash and dry the armor panels as long as "wash and wear" or "permanent press" cycles are used.

In the garment as heretofore described and illustrated, the pocket for receiving panel 12 is located in front of the pocket for receiving the larger panel 16. In an alternative construction, however, these pockets may be transposed so that the large panel 16 fits in front of the smaller panel 12. With this arrangement, a sheet of material forming the smaller pocket may be sewn onto a sheet forming the larger pocket.

An arrangement wherein the larger armor insert panel is situated in front of the smaller panel may enhance the bullet resistance of the garment by reducing the possibility of bagging or separation of the panels if the wearer is seated or bent over. Also, the positioning of the wider armor panel in front of the standard panel provides a smoother, unbroken external visual contour for the wearer with enhanced wearer comfort.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An article of body armor comprising a standard-style undergarment such as a T-shirt having front and rear panels defining a neck opening, a first piece of material seamed along bottom and side edges thereof to an inner surface of the front panel so as to provide a first open-topped pocket in the front of the undergarment covering a substantial area of the front panel, a second piece of material seamed along bottom and side edges thereof to an inner surface of the rear panel so as to provide a second open-topped pocket in the rear of the undergarment covering a substantial area of the rear panel, and first and second armor insert panels of soft armor construction comprising plural layers of flexible sheet material for selective receipt in and removal from the respective pockets through the open tops thereof.

2. The invention of claim 1 wherein the pockets and the armor insert panels are of like shape and size for interchangeable receipt of the panels in the respective pockets.

3. The invention of claim 1 wherein the first and second pieces of material include panel-retaining internal flaps along respective upper edges thereof.

4. The invention of claim 1 including a further sheet of material secured internally to the front panel of the undergarment behind the first sheet to define a further open-topped pocket behind the first pocket for receipt of a further armor insert panel.

5. The invention of claim 4 wherein the further pocket and panel are of inverted T-shape to protect a wearer's kidney regions.

6. A range of body armor comprising standard-style undergarments such as T-shirts of different sizes, means defining receiving pockets in the respective garments, and armor insert panels of soft armor construction comprising plural layers of flexible sheet material for receipt in the respective pockets, wherein the receiving pockets are of the same size and shape in each garment, and the armor insert panels are of the same size and shape for interchangeable receipt in the respective pockets.

7. The invention of claim 6 wherein each garment has front and rear internal top-opening pockets of like rectangular size and shape for receipt of the respective panels.

8. An undergarment comprising front and rear panels defining a neck opening, a first sheet of rectangular material seamed internally to the front panel to define a first top-opening rectangular pocket for removable receipt of a first armor insert panel of soft multilayer armor fabric, and a second sheet of rectangular material seamed internally to the rear panel to define a second top-opening rectangular pocket of like dimensions to the first pocket for removable receipt of a second armor insert panel of soft multilayer armor fabric and like dimensions to the first panel whereby the panels may be interchangeably received in the respective pockets to cover substantial areas of a wearer's chest and back.

9. The invention of claim 8 wherein the first and second sheets of material define internal flaps along respective upper edges thereof for retaining the respective armor insert panels in the pockets.

* * * * *